United States Patent [19]

Castricum

[11] Patent Number: 5,020,351

[45] Date of Patent: Jun. 4, 1991

[54] APPARATUS FOR FLATTENING IRREGULAR CIRCUMFERENTIAL SURFACES IN SPIRALLY FORMED PIPE

[75] Inventor: Wilhelmus P. H. Castricum, Rolling Meadows, Ill.

[73] Assignee: Spiro America Inc., Wheeling, Ill.

[21] Appl. No.: 528,247

[22] Filed: May 24, 1990

[51] Int. Cl.[5] ..... B21C 37/12

[52] U.S. Cl. ..... 72/70; 72/49; 72/96

[58] Field of Search ..... 72/49, 50, 48, 72, 96, 72/208; 228/145, 125; 409/299

[56] References Cited

U.S. PATENT DOCUMENTS

| | | | |
|---|---|---|---|
| 3,093,103 | 6/1963 | Berkeley | 72/49 |
| 3,268,137 | 8/1966 | Martin | 72/00 |
| 3,662,579 | 5/1972 | Lewis | 72/00 |
| 4,018,072 | 4/1977 | Davis | 72/00 |
| 4,041,747 | 8/1977 | Elkin | 72/00 |
| 4,091,648 | 5/1978 | McCaslin | 72/00 |
| 4,711,110 | 12/1987 | Castricum | 72/00 |
| 4,924,684 | 5/1990 | Castricum | 72/49 |

FOREIGN PATENT DOCUMENTS

| | | | |
|---|---|---|---|
| 0012132 | 3/1985 | Japan | 72/96 |

*Primary Examiner*—Lowell A. Larson
*Assistant Examiner*—Michael J. McKeon
*Attorney, Agent, or Firm*—Willian Brinks Olds Hofer Gilson & Lione

[57] ABSTRACT

An apparatus for flattening irregular circumferential surfaces in spirally formed pipe and for cutting such pipes is disclosed. The apparatus includes a pipe surface flattening assembly and a rotating knife assembly. The pipe surface flattening assembly includes an upper roller and a lower roller which are brought into flattening contact with the surface of the pipe in the area to be cut. The rollers move axially with the pipe and cooperate with an inner roller located inside the pipe to flatten any raised surface irregularities on the inside and outside surface of the pipe as the pipe rotates between the rollers. The rotating knife assembly includes an inner knife located inside the pipe and an outer wire positioned outside the pipe. A rotatable support roller is positioned outside the pipe, and opposite the outer knife. To cut the pipe, the outer knife punctures the pipe in the area previously flattened. The outer knife overlaps the inner knife and the support roller abuts the opposite side of the pipe. The inner and outer knives and the support roller move axially with the pipe. As the pipe continues to rotate, it is completely severed.

14 Claims, 5 Drawing Sheets

88
80H
80B
94
96
98
102
104
106
108
110
112
114
116
118
3a.
3b.
4.
90
92
25

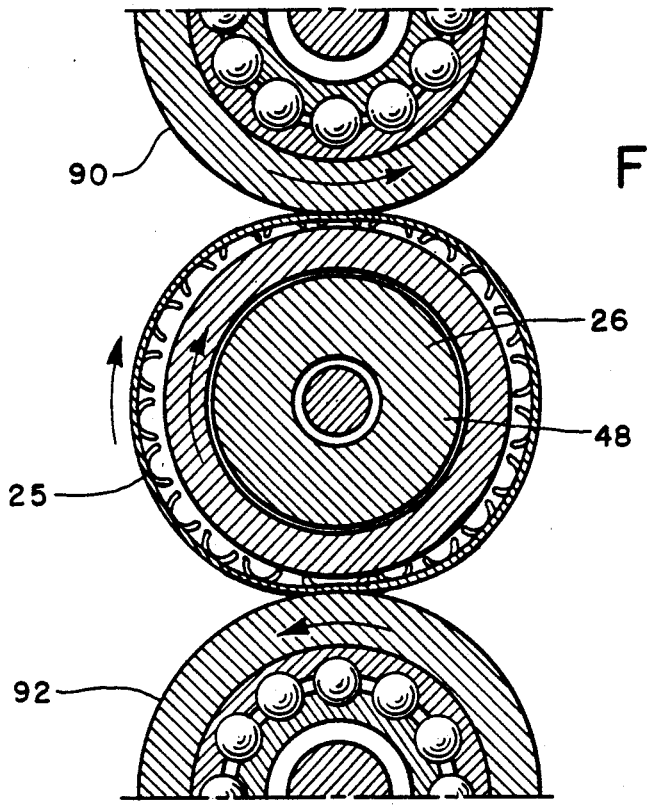
FIG. 5
FIG. 6
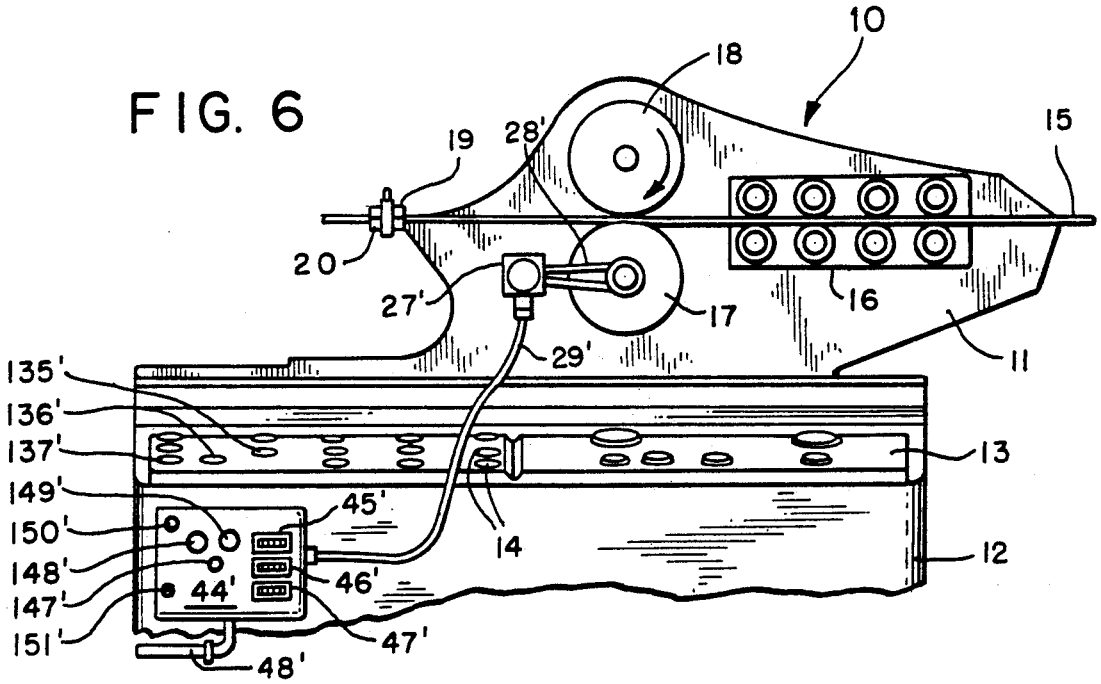

APPARATUS FOR FLATTENING IRREGULAR CIRCUMFERENTIAL SURFACES IN SPIRALLY FORMED PIPE

BACKGROUND OF THE INVENTION

This invention relates to an apparatus for flattening irregular circumferential surfaces in spirally formed pipes, and an apparatus for cutting such pipes.

As discussed in my U.S. Pat. No. 4,823,579, issued Apr. 25, 1989, and my U.S. Pat. No. 4,567,742, issued Feb. 4, 1986, there are many ways to form a pipe by spirally winding a continuous strip of metal. My U.S. Pat. No. 4,567,742 describes a machine which starts with a flat strip of metal. The strip passes through a series of rollers which bend the edges into predetermined shapes, and form parallel corrugations in the strip. The strip then passes around the inner surface of the forming head in a spiral manner, so that the strip takes a spiral shape with opposite edges of the strip meshing. The intermeshed edges of the strip are then compressed to form the pipe with a spiral lockseam. The strip is continuously fed into the machine to continuously produce spiral pipe. The spirally formed pipe moves away from the forming head in the axial direction of the pipe and rotates.

At some point, the pipe will reach its desired length and must be cut. In the past, a rotary saw was used for cutting the pipe. There are many disadvantages to using a rotary saw to cut metal pipes. First, the saw blade, rotating as fast as 5000 RPM, is dangerous to the machine operator and anyone near the machine. Second, the saw generates a lot of sparks when it cuts the metal, which also creates a hazardous situation. Third, the saw cut leaves burrs on the edge of the pipe. These burrs must be filed off in a secondary operation, which increases pipe production costs. Finally the cutting operation generates high noise levels.

My pending U.S. patent application Ser. No. 07/315,373, filed Feb. 23, 1989, discloses a cutting apparatus for hollow metal pipes that overcomes the disadvantages of high speed saw blades. In that apparatus, a first rotatable knife is positioned inside the spiral pipe, a second rotatable knife is positioned outside of the pipe, and a support roller is positioned outside the pipe and opposite the outer knife. To cut the pipe, the outer knife is moved into an overlapping relationship with the inner knife, and the support roller is moved into contact with the pipe. The overlapping knives and support rollers move axially with the pipe and cooperate to cut the pipe as the pipe move axially and rotates between the overlapping inner and outer knifes.

The pipe cutting apparatus of my U.S. patent application Ser. No. 07/315,373, described above, uses a slitter-type shearing action to cut the pipe. The pipe is cut without the sparks, noise, and danger of a high-speed saw blade. Thus, this apparatus provides a safer environment for manufacturing spiral seamed pipe.

The above described cutting apparatus of my pending U.S. patent application Ser. No. 07/315,373 worked satisfactorily when the spiral pipes were formed from flat strips of metal having a flat surface configuration. With a flat strip of metal the spiral pipe forming apparatus would create a pipe with a relatively smooth inside and outside circumferential surface which the rotating knives could cut cleanly with a minimum of material burring or deformation to the circular cross section of the pipe.

But often it is necessary to use metal strips having various non-flat surface configurations for different spiral pipe applications. For example, fluting, louvers, or corrugations may be required in the spiral pipe surface. Also, when multiple perforations are required in the spiral pipe, it may be preferred to punch the perforations in the metal strip during the pipe forming process using the drive rollers of the forming apparatus. The punching of perforations in the metal by the drive rollers during the forming process is less expensive than using pre-perforated, flat metal strip. But the punching process deforms the metal strip sheet around the perforated area creating raised surface irregularities.

With the above types of non-flat surface configurations, the cutting apparatus of my previous invention sometimes would not cut a clean edge on the formed spiral pipe. The rotating knife assembly would deform the irregular circumferential pipe surface during the rotating cutting process, sometimes resulting in a rough, non-uniform cut. Also, because of the non-flat surface configurations in the material and deformation during the cutting of the pipe, the ends of the pipe would often not have a smooth and circular inside and outside surface at the cut. A smooth, circular cross-section at the pipe end is often a necessity for proper mating of the pipe with other components in an end use application.

SUMMARY OF THE INVENTION

The present invention is directed to an apparatus for flattening irregular circumferential surfaces in spirally formed pipe and for cutting such pipes.

The apparatus comprises two major assemblies, a pipe surface flattening assembly and a rotatable knife assembly. The pipe surface flattening assembly preferably includes an inner roller positioned inside the spiral pipe and outer rollers positioned outside the pipe. The rotatable knife assembly includes an inner rotatable knife to be positioned inside the pipe, and an outer rotatable knife to be positioned outside the pipe.

Before cutting the pipe, the outer rollers are first brought down under pressure into contact with the outside surface of the pipe at a location above and below the inner roller located in the spiral pipe. The rollers will move axially with the pipe and cooperate to flatten irregularities in the inside and outside surfaces of the pipe as the pipe moves axially and rotates between the rollers. After the rollers have created a flattened band around the pipe, the outer rollers will be brought away from the pipe surface, and the knife assembly will be aligned to the center of the flattened band area on the pipe. Next, the outer knife is moved into an overlapping relationship with the inner knife, and the overlapping knives will move axially with the pipe and cooperate to cut the pipe as the pipe moves axially and rotates between the overlapping inner and outer knives.

The present invention provides an improvement in the cutting of spiral pipe. By flattening surface irregularities in the spiral pipe in the area of the cut before cutting, the rotating knives have a smooth, uniform inside and outside circumferential surface to cut through. This results in a clean cut with a minimum of material burring. Also, the pipe maintains a smooth, circular cross-section at the cut, which is necessary in many spiral pipe applications where the end of the pipe must mate properly with other cylindrical components.

The invention itself, together with further objects and attendant advantages, will be best understood by reference to the following detailed description taken in conjunction with the drawings.

BRIEF DESCRIPTION OF THE DRAWINGS

FIG. 5 is a sectional view taken along lines 5—5 of FIG. 4 of the upper roller, inner roller, lower roller, and the pipe of the present invention.

FIG. 6 is a side elevation view of a spiral pipe forming machine with which a preferred embodiment of the present invention can be used.

DETAILED DESCRIPTION OF A PREFERRED EMBODIMENT

Figure 1:
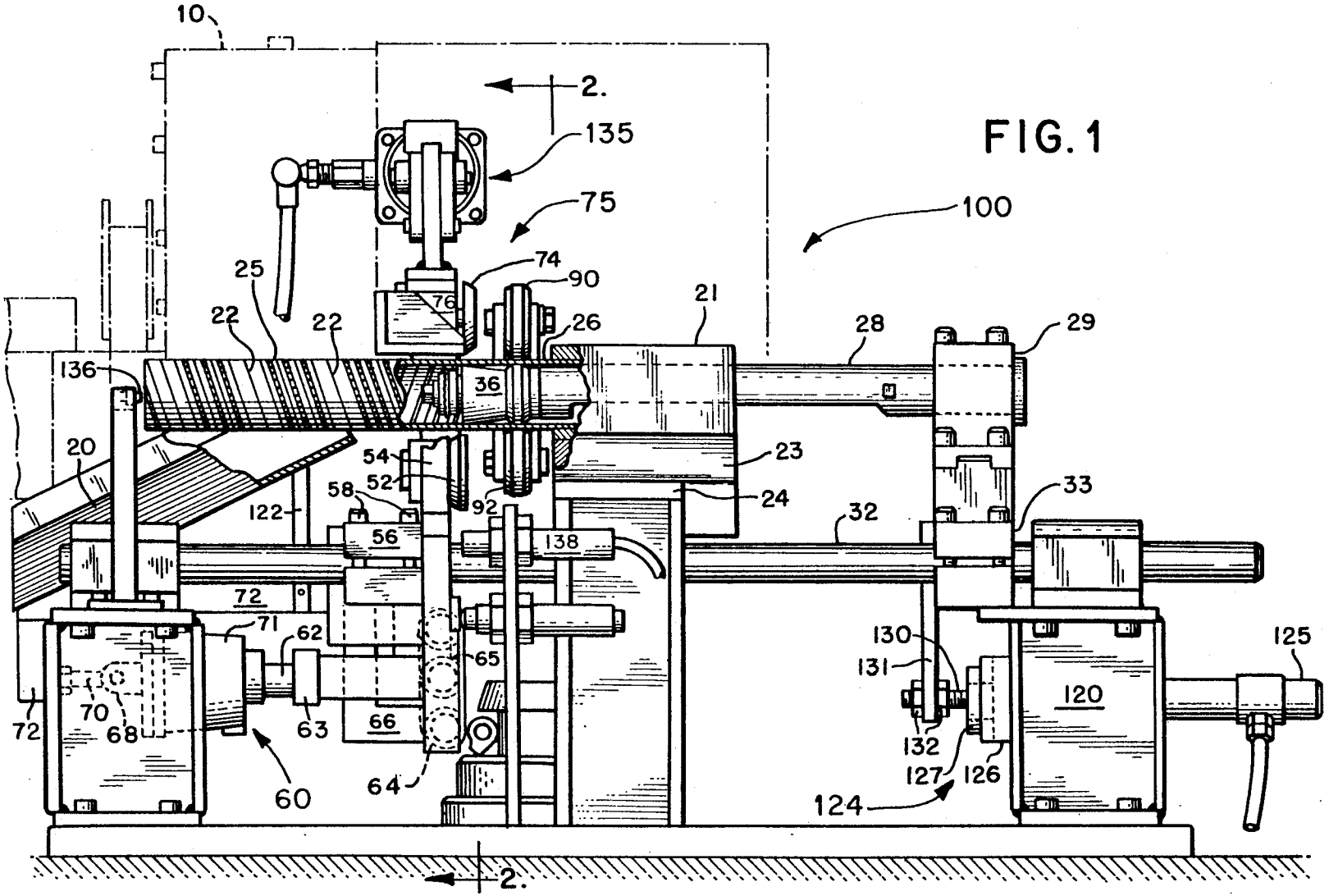
FIG. 1 is a side elevation view of a preferred embodiment of the present invention.

Referring now to the drawings, FIG. 1 shows the combination 100 of a spiral pipe forming apparatus 10 and the cutting apparatus 75 of the present invention. The spiral pipe forming apparatus 10 is briefly described below as it relates to the cutting apparatus 75 of the present invention. A more detailed explanation of pipe forming machines that may be used with the present invention can be found in my U.S. Pat. No. 4,567,742, (see FIGS. 1, 2, 6 and 7) and U.S. Pat. No. 3,132,616 (Hale). These patents are incorporated by reference herein and made a part hereof for their descriptions of spiral pipe forming machines. It should be understood, however, that the present invention is intended to be used with any type of spiral pipe producing machine, not just those shown in the foregoing patents.

FIG. 6 shows some of the elements of the pipe forming machine 10. The machine includes a frame 11 and a control cabinet 12. A control panel 13 contains a plurality of control elements 14, such as knobs, gauges and dials, for controlling and monitoring the operation of the pipe forming machine 10 and the cutting apparatus 75. The functions of the various control elements are described in my U.S. Pat. No. 4,706,481, issued Nov. 17, 1987. The descriptions of the control elements contained in that patent are incorporated by reference herein, and made a part hereof.

A continuous metal strip 15 is fed into the frame 11 of the pipe forming machine 10. The metal strip 15 passes through a roller housing 16 that contains a plurality of rollers that form the lockseam edges, corrugation grooves, punched perforations, flutes, louvers, or other required patterns in the metal strip.

A lower drive roller 17 and an upper drive roller 18 are rotatably mounted in the frame 11. The drive rollers cooperate to pull the metal strip 15 into the frame 11 and through the roller housing 16. The two drive rollers 17, 18 then push the metal strip 15 between the upper guide plates 19 and lower guide plates 20 into the forming head 21. The width of the drive rollers 17, 18 and the guide plates should be adapted to conform to the width of the strip 15.

The forming head 21 curls the metal strip in a helical fashion so that the outer pre-formed edges of the strip 15 are adjacent to each other and mesh. The helically curled strip thus takes the shape of a spiral cylinder. The adjacent, mated edges of the strip are then compressed between a set of seam rollers (not shown) to form a lockseam 22 as described in my U.S. Pat. No. 4,567,742. The forming head 21 is secured to a forming head base 23 which is detachably secured to a forming head table 24. Different size forming heads 21 can be used with the same spiral pipe producing apparatus 10 to produce spiral pipe of various diameters.

It should be understood that as the spiral pipe 25 is formed, it will move out of the forming head 21 in a spiral manner. That is, the spiral pipe 25 and its leading edge will simultaneously rotate and move forward in the axial direction of the pipe. The spiral pipe 25 will be continuously produced until it reaches its desired length. At that point, the pipe cutting apparatus 75 will sever the pipe into a section.

The preferred embodiment of the cutting apparatus 75 of the present invention shares many identical components with the slitting apparatus disclosed is my pending U.S. patent application Ser. No. 07/315,373, ('373 application) filed Feb. 23, 1989. The description of the pipe slitting apparatus of my above '373 application is incorporated by reference herein, and made part hereof.

Figure 4:
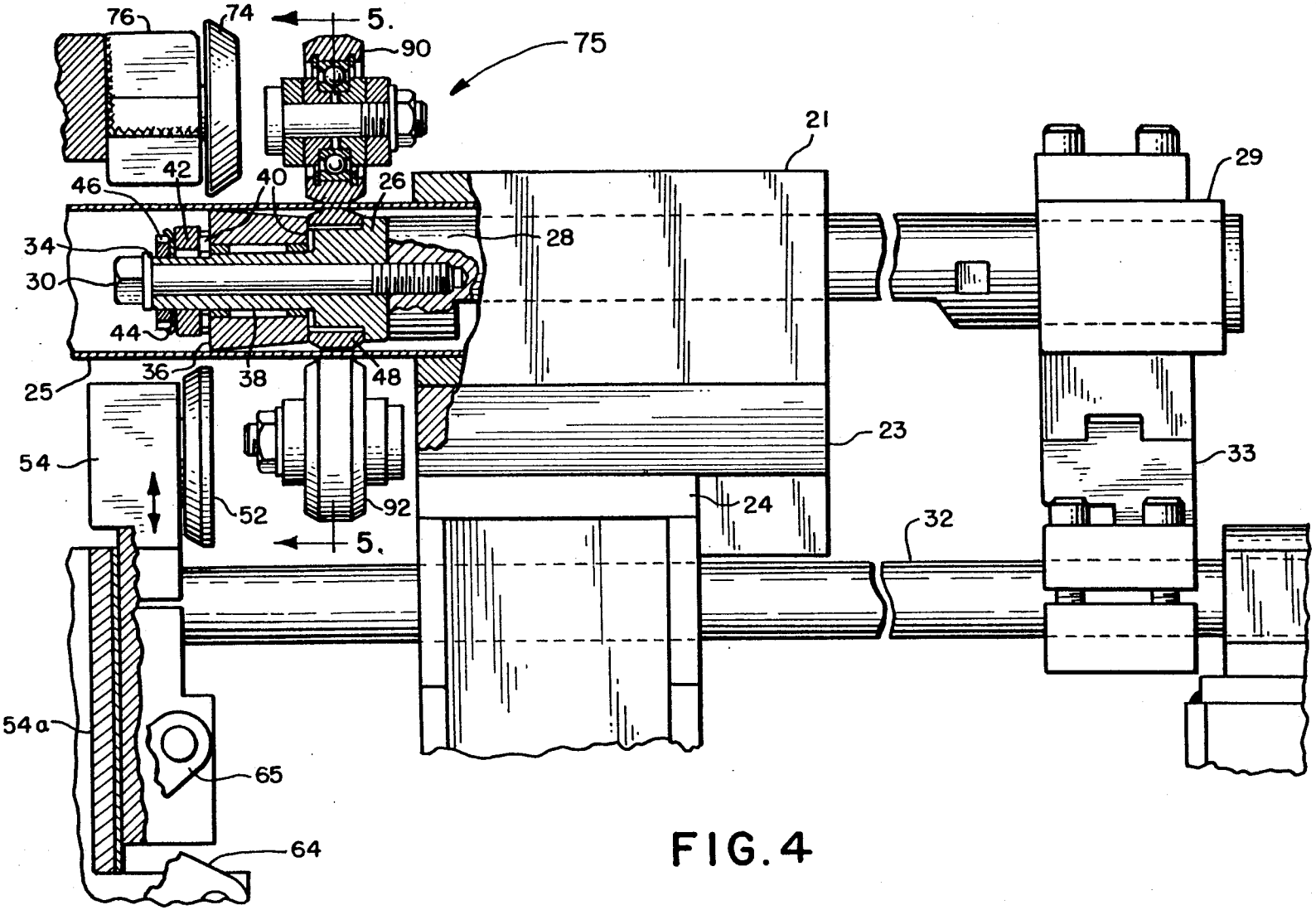
FIG. 4 is a side view, partially in elevation and partially in section, of part of the preferred embodiment of the present invention.

Referring now to FIGS 1 and 4, an arbor 26 is fixedly secured to the end of a boom 28 with a bolt 30. The boom 28 passes through the spiral pipe 25 and is mounted on the opposite end to a boom holder assembly 29 so as to not allow rotation of the boom 28. The boom holder assembly 29 is connected to guide shafts 32 by a shaft connector 33 as described in detail in my U.S. Pat. No. 4,823,579. This connection allows the boom 28 to slide axially with the guide shafts 32. A washer 34 is positioned between the bolt 30 and the arbor 26. An inner knife 36 is concentrically mounted about the cylindrical arbor 26 in a manner allowing the inner knife 36 to rotate about the axis of the non-rotating arbor 26. Needle bearings 38 and thrust bearings 40 located between the arbor 26 and inner knife 36 allow the inner knife 36 to freely rotate about the fixed arbor 26. Thrust washer 42, lock washer 44, and locknut 46 retain the inner knife 36 on the arbor 26 and prevent the inner knife 36 from moving in an axial direction. The inside diameter of the inner knife 36 is preferably slightly oversized, allowing the inner knife 36 to float slightly in the radial direction.

Also mounted concentrically about the arbor 26 is inner roller 48. The inside diameter of the inner roller 48 is slightly larger than the corresponding diameter of the arbor 26, allowing the inner roller 48 to passively rotate and float slightly in the radial direction during the pipe rolling and cutting process. The inner roller 48 outside diameter is preferably as large as possible without interfering with the inside surface of the spiral pipe 25 during the forming process. Typically, the outside diameter of the inner roller 48 is 0.010 inches smaller than the inside surface diameter of the spiral pipe 25. In this particular embodiment, the preferred distance between the inner knife 36 cutting edge and the center of the inner roller 48 is equal to one-half the "pitch" of the spiral pipe 25 plus 0.125 inches. The "pitch" value for a particular spiral pipe 25 may be calculated using the equation, pitch=$(B \times \tan \bar{O})^2 + B^2$, where $\bar{O}$ equals the helix angle of the spiral pipe 25, and B is equal to center-to-center distance between the lockseams 22 of the spiral pipe 25.

An outer knife 52 is generally positioned below the inner knife 36 and outside of the pipe 25. The outer knife is held in a vertical holder 54 by a lock washer and lock nut that are connected to the shaft of the knife. Bearings (not shown) permit the outer knife 52 to be passively rotatable, that is, rotationally driven by contact with the rotating pipe 25. The vertical holder 54 is attached to the central portion of a knife slide block 56 through a slide bearing assembly 54*a* as described in detail in my '373 application. The vertical holder 54 and outer knife 52 can thus slide up and down relative to the knife slide block 56 as in my '373 application. The knife slide block 56 has two cylindrical openings through which the guide shafts 32 pass. A plurality of allen bolts 58 squeeze together the sides of these openings around the guide shafts 32, so that the knife slide block 56 is also affixed to and slides axially with the guide shafts 32.

During the pipe forming process, the outer knife 52 must be maintained in a standby position, where it will not interfere with the spirally moving pipe 25. When it is time to cut the pipe, the outer knife blade is moved to a cutting position, where it punctures the spiral pipe 25 and overlaps the inner knife 36.

As described in my '373 application, the outer knife 52 is moved into and out of its cutting position by the pneumatic cylinder assembly 60. This assembly includes a pneumatic cylinder 61 that controls a piston 62. A lower clevis 63 is attached to the piston 62 and a set of toggle links 64, 65. The lower links 64 are pivotally connected to the clevis 63 and an arm 66 which is integral with and extends from the central portion of the knife slide block 56. The upper toggle links 65 are pivotally connected to the clevis 63 and the bottom of vertical holder 54. Thus, when the piston 62 is fully extended, the vertical holder 54 and lower knife 52 will be raised vertically into the cutting position where the cutting edges of the inner and outer knives overlap and puncture the pipe 25. When the piston 62 is retracted into the cylinder 61, the toggle links 64 and 65 will collapse and pull down the vertical holder 54 and the outer knife 52 to the standby position.

An upper clevis 68 is attached to the top of the cylinder 61. The upper clevis 68 is pivotally connected to a threaded shaft 70. Nuts secure the threaded shaft 70 to one end of a cylinder support bracket 72. The other end of the cylinder support bracket 72 is attached to the central position of the knife slide block 56. (The vertical holder 54 is connected to the opposite side of the knife slide block 56.) As a result of its connection to the knife slide block 56, the cylinder support bracket 72 and other components of the pneumatic cylinder assembly 60 move axially with the guide shafts 32. The threaded shaft 70 of the pneumatic cylinder assembly 60 permits adjustment of the standby and cutting positions of the outer knife 52.

The cutting apparatus 75 of the present invention also includes a support roller 74. The shaft of the support roller is mounted in one end of a roller holder 76, which contains bearings that permit the support roller to be passively rotatable. The other end of the roller holder 76 pivots around a pin 78 that is secured in an upper roller bracket 80. During the pipe forming process, the support roller 74 is maintained in a standby position where it will not interfere with the spirally moving pipe 25 (see, e.g., FIG. 1). When it is time to cut the pipe and the outer knife 52 is moved to its cutting position, the support roller 74 is simultaneously moved to its extended position, where it contacts the top side of the spiral pipe. The support roller 74 is positioned outside of the pipe and 180 degrees opposite the outer knife 52. The support roller 74 thus operates to prevent the boom 28 from deflecting upward in response to the force exerted by the outer knife 52. With small diameter pipes, it is more difficult to keep the boom 28 rigid. If the boom 28 moves away from the pipe, the inner and outer knives will not overlap and cut the pipe. The support roller 74 thus maintains the inner and outer knives in an overlapping relationship during the slitting process. The support roller 74 is moved into and out of its standby position by the pneumatic cylinder assembly 82 as described in detail in my '373 application.

The upper roller bracket 80 consists of two vertical members 80-F and 80-B that are connected to opposite ends of the knife slide block 56. An overhead member 80-H is bolted to the tops of the two vertical members 80-F and 80-B. The bolts pass through oval slots in the overhead member 80-H, which permit angular adjustment of the support roller position. It is overhead member 80-H to which the upper pneumatic cylinder assembly 82 is connected via its vertical support member 84 and upper toggle bracket 86. The support roller 74 also moves in the axial direction of the pipe during the cutting operation because the upper roller bracket 80 is connected to the guide shafts 32 via the knife slide block 56.

Figure 2:
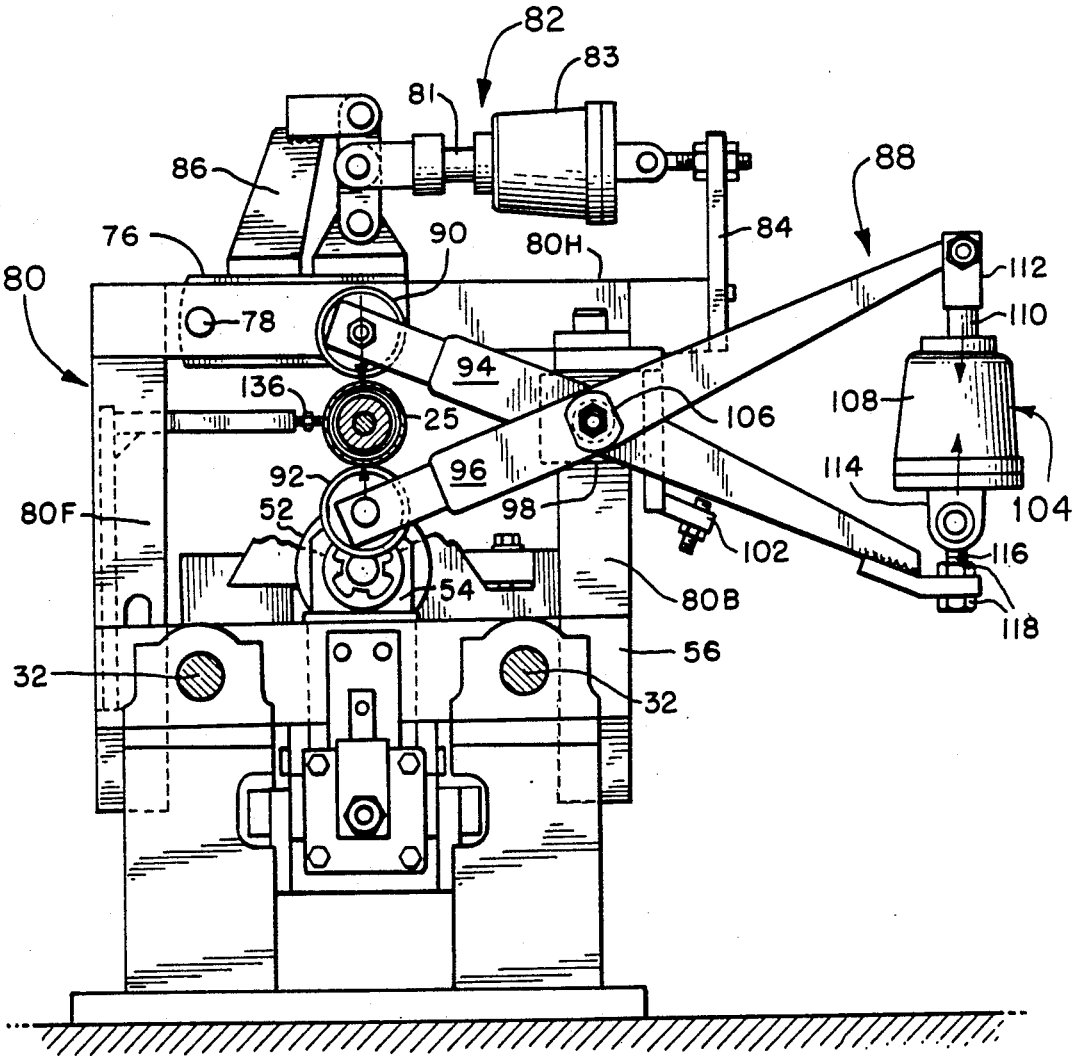
FIG. 2 is a rear elevation view taken along lines 2—2 of FIG. 1.
Figures 3, 3A, 3B:
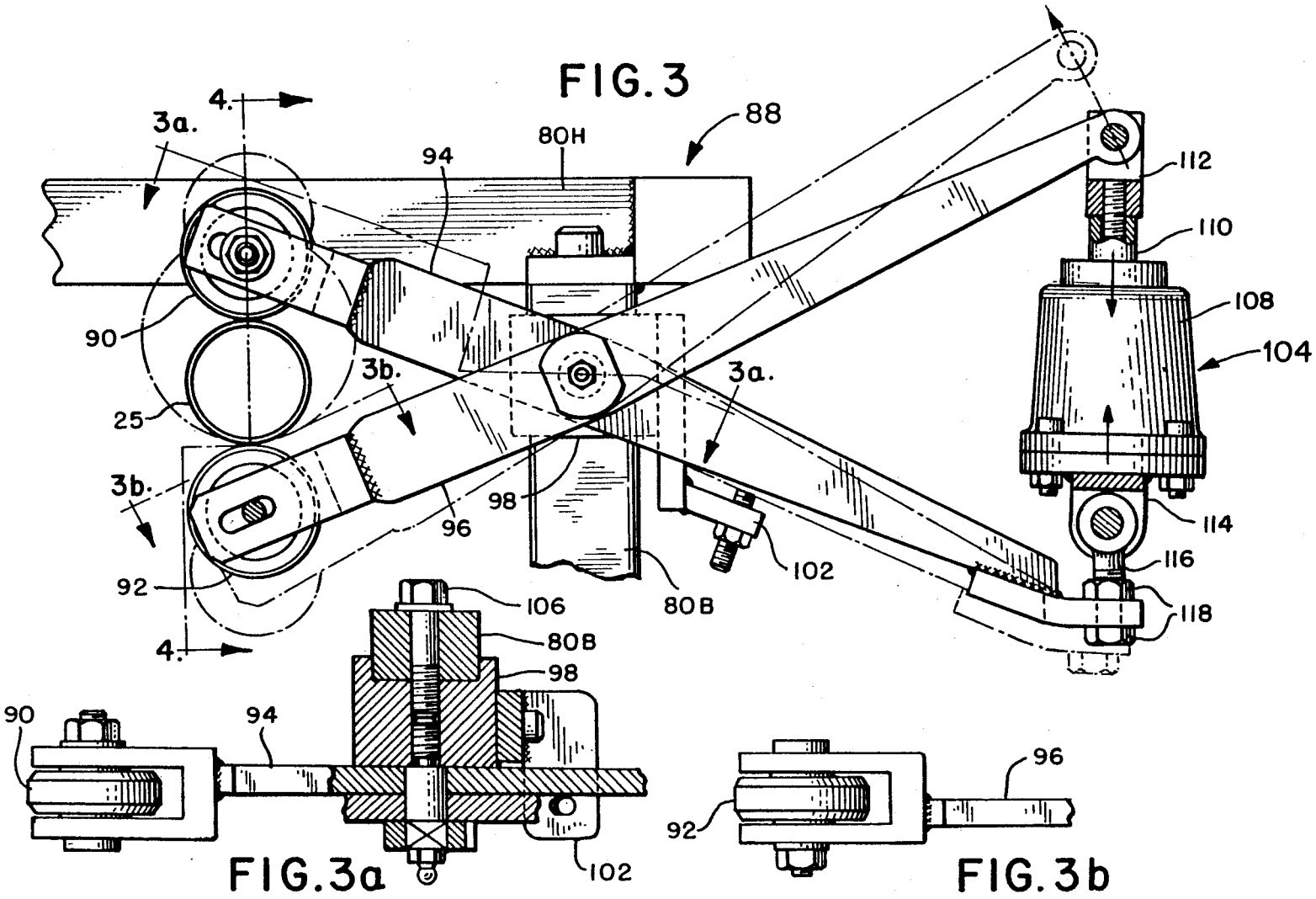
FIG. 3 is an enlarged partial view of FIG. 2, showing the pipe surface flattening assembly in greater detail.
FIG. 3*a* is a sectional view of the pipe surface flattening assembly taken along lines 3*a*—3*a* of FIG. 3.
FIG. 3*b* is a sectional view of the pipe surface flattening assembly taken along lines 3*b*—3*b* of FIG. 3.

As best shown in FIGS. 2 and 3, a pipe surface flattening assembly 88 is mounted to the vertical member 80-B of the upper roller bracket 80. The pipe surface flattening assembly comprises an upper roller 90, a lower roller 92, an upper lever arm 94, a lower lever arm 96, a pivot block 98, an upper roller stop 102, and a pneumatic cylinder assembly 104. The upper lever arm 94 and lower lever arm 96 are pivotably mounted to the pivot block 98 using a pivot bolt 106. The pivot block is fixed to the vertical member 80-B of the upper roller bracket. The upper roller 90 and lower roller 92 are mounted in slots located on the ends of the upper lever arm 94 and lower lever arms 96. The slots allow the position of the rollers to be adjusted for optimal flattening performance. Bearings allow the upper roller 90 and lower roller 92 to rotate freely when in contact with the rotating spiral pipe 25.

Attached to the upper lever arm 94 and lower lever arm 96 on the ends opposite the upper roller 90 and lower roller 92 is the pneumatic cylinder assembly 104. The pneumatic cylinder assembly 104 includes a pneumatic cylinder 108 that controls a piston 110 and is similar to the pneumatic cylinder assembly 60 used in conjunction with the outer knife 52. The piston 110 is attached to a rod clevis 112, which is pivotally connected to the lower lever arm 96. A cylinder clevis 114 is attached to the pneumatic cylinder 108 and pivotably connected to the upper lever arm 94 through a threaded shaft 116 and nuts 118. The threaded shaft 116 permits adjustment of the amount of pressure the upper and lower rollers 90, 92 will exert against the pipe 25 when the piston 110 is retracted.

The upper roller 90 and lower roller 92 are positioned outside the spiral pipe 180° apart directly above and below the inner roller 48. During the pipe forming process, the rollers 90, 92 must be maintained in a standby position, where they will not interfere with the spirally moving pipe. When the piston 110 is extended, the upper roller 90 and lower roller 92 are pivoted away from the spiral pipe 25 into the standby position. When the piston 110 is fully retracted, the upper roller 90 and lower roller 92 are brought into pressure contact with the outside surface of the spiral pipe 25, allowing the upper roller 90 and lower roller 92 to flatten the pipe 25 surfaces against the inner roller 48. (See FIGS. 3 and 5.)

The pipe surface flattening assembly 88 moves in the axial direction of pipe during the flattening/cutting operation since it is connected to the guide shafts 32 via the knife slide block 56 and the upper roller bracket 80.

A slide 120 is provided to catch pipe sections that have been severed by the cutting apparatus 75. The slide 120 has a vertical flange 122 that is connected to the cylinder support bracket 72. The slide 120 also moves in unison with the pipe surface flattening assembly 88, boom 28, cutting knives 36, 52 and support roller 74 during the cutting operation.

When the upper roller 90 and lower roller 92 are brought into contact with the spiral pipe or the outer knife 52 punctures the pipe 25 and overlaps the inner knife 36, the guide shaft 32 allows the axially moving pipe to push the pipe flattening assembly 88, the knives and the support roller, the boom 28, and their connected components, in unison with the pipe. An axial motion cylinder assembly 124 is provided to assist the axial movement of the pipe cutting apparatus 75. As best shown in FIG. 1, this assembly 124 includes a pneumatic cylinder 125 which is supported by a piece of flat stock 126, and held in place by a nut 127. The flat stock 126 is attached to a mounting leg 128. A piston 130 is secured to a second piece of flat stock 131 by a pair of nuts 132. The second piece of flat stock 131 is bolted to the central inner portion of the shaft connector 33. When air is supplied to the cylinder 125 in one direction, the piston 130 extends out of the cylinder, and pushes the shaft connector 33, and its connected components, in the axial direction of the pipe 25. When the air to the cylinder 125 is reversed, the piston 130 retracts and pulls the pipe flattening assembly 88, the boom 28, inner roller 48, and the inner and outer knives 36, 52, back to their starting position. The air supplied to the cylinder assembly 124 is adjusted to assure that the pipe flattening assembly 88, the boom 28, inner roller 48, knives 36, 52, and support roller 74 move at the same axial speed as the pipe 25 so that a smooth, flattened band and a clean, rectangular cut is obtained. A stop/shock-absorber mechanism 134 is provided to fix the begin-roll and begin-cut position.

The operation of the cutting apparatus 75 of the preferred embodiment of the present invention will now be described. The operation is similar in many respects to that described in detail in my pending '373 application incorporated above.

In the combination pipe former/cutter 100 a strip of metal 15 is pulled into the roller housing 16 by the drive rollers 17 and 18. In the roller housing 16, the strip is corrugated, fluted, louvered or perforated, and the edges of the strip are formed in the shapes desired to produce a spiral lockseam. Drive rollers 17 and 18 then push the formed strip through the guide plates 19 and 20 and into the forming head assembly 21. The forming head 21 curls the metal strip in a helical fashion so that the outer pre-formed edges of the strip 15 are adjacent to each other and mesh. The helically curled strip thus takes the shape of a spiral cylinder. The adjacent, mated edges of the strip 15 are then compressed between a set of seam rollers (not shown) as described in my U.S. Pat. No. 4,567,742 to form a lockseam 22.

As the spiral pipe production continues, the pipe 25 moves out of the forming head 21 in a helical fashion. That is, the pipe 25 moves in its axial direction while it rotates. During the pipe production process, the upper roller 90, lower roller 92, outer knife 52 and the support roller 74 are all in their standby positions, as well as in the starting begin-roll and begin-cut positions. Thus, the pneumatic cylinder assemblies 60, 82 and 124 have their respective pistons fully retracted and pneumatic cylinder assembly 104 has its piston fully extended. When the pipe 25 reaches a predetermined length, air will be released from pneumatic cylinder assembly 104 allowing the piston 110 to retract, bringing the upper and lower rollers 90, 92 into circumferential contact with the pipe 25. At the same time, air will be sent to pneumatic cylinder assembly 124 to fully extend its piston, which pushes all of the components connected to the guide shafts 32, including the upper roller 90, lower roller 92, boom 28, and the inner roller 48 in the axial direction of the pipe.

As the pipe forming machine 10 continues to produce the pipe 25 in a spiral manner, the pipe 25 moves axially with and rotates between the upper roller 90, lower roller 92, and the inner roller 48. When the pipe completes slightly over 180½ of revolution after contacting the rollers, the rollers 48, 90, 92 will have flattened any raised surfaces on the inside and outside of the pipe over a circumferential band between the rollers. At this point, the end of the pipe 25 will run into and trigger a stationary limit switch 136 and the production of pipe and its helical movement will be halted momentarily. At this time, the pneumatic cylinder assembly 104 will be charged with air to fully extend the piston 110, thus pivoting the rollers 90, 92 to their standby position.

Simultaneous with the halting of pipe 25 production, the pneumatic cylinder 125 is discharged of air allowing its piston to retract, thus pushing all the components connected to the guide shafts 32, including the pipe surface flattening assembly, boom 28, inner and outer knives 36, 52, and the support roller 74 back to the begin-cut position. The begin-cut position is located approximately in the center of the flattened circumferential band previously created by the rollers 48, 90, 92. When the outer knife 52 and inner knife 36 reach the begin-cut position, pipe production will resume, and the pneumatic cylinders 60, 82, and 124 will be charged with air to fully extend their respective pistons. Thus, the pneumatic cylinder assembly 60 pushes the outer knife 52 upward so that it punctures the pipe 25 and overlaps the inner knife 36. The pneumatic cylinder assembly 82 pushes the support roller 74 downward, so that it is in circumferential contact with the spiral pipe 25. The pneumatic cylinder assembly 124 extends its piston, which pushes all of the components connected to the guide shafts 32, including the inner and outer knives 36, 52 and the support roller, in the axial direction of the pipe. As the pipe forming machine 10 continues to produce the pipe 25 in a spiral manner, the pipe moves axially with, and rotates between the overlapping inner knife 36 and the outer knife 52. After the pipe completes one revolution, the section of the pipe 25 in front of the overlapping knives will be completely severed and will fall into the slide 120.

Once the cutting process is complete, the air supplied to the pneumatic cylinder assemblies 60, 82 and 124 will be reversed. As a result, the support roller 74 and the outer knife 52 will be returned to their standby positions, and the piston 130 will pull all the components connected to the guide shafts 32, including both knives, the support roller, the boom 28, and the pipe surface flattening assembly 88 back to the starting begin-roll and begin-cut position.

To operate the cutting apparatus in an automatic mode, an electrical encoder 27' is coupled to the lower drive roller 17 of the pipe producing machine 10 by a pulley belt 28'. The encoder 27' is adapted to generate pulses corresponding to the number of rotations of the lower drive roller 17. These pulses are transmitted over a cable 29' to three counters 45', 46', and 47' included in a control box 44'. A first pulse count corresponds to the desired pipe length and is set with the first counter 45'. A second pulse count corresponds to the slow-down point for pipe production and is set with the second counter 46'. A third pulse count corresponds to the amount of axial travel of the pipe required for the pipe to be cut by the cutting apparatus 75 (i.e. cut length) and is set with the third counter 47'. The control box 44' sends electrical signals to operate the various pneumatic cylinder assemblies 60, 82, 104, and 124 over line 48' in response to the first, second and third pulse counts.

The control box 44' also has five control switches 147', 148', 149', 150, and 151'. A first control switch 147' selects manual or automatic control of the pipe cutting apparatus 75. In the manual mode, the second, third, fourth, and fifth control switches 148', 149', 150', and 151' are operable to manually actuate the various pneumatic cylinders 61, 83, 108, and 125. That is, the second control switch 148' may be used to move the piston rod 62 in and out of its cylinder 61, and thereby move the outer knife 52 into and out of its cutting position. The third control switch 149' may be used to move the piston 130 in and out of its cylinder 125, and hence slide the pipe surface flattening assembly 88, boom 28, inner knife 36, outer knife 52 and support roller 74 in the axial direction of the pipe 25. The fourth control switch 124' may be used to move the piston 81 in and out of its cylinder 83, and thereby move the support roller 74 in and out of its contact position. The fifth control switch 151' may be used to move piston 110 in and out of its cylinder 108, and hence pivot the rollers 90, 92 into contact position. When the first control switch 147' is put into automatic mode, the second, third and fourth and fifth control switches 148', 149', 150', and 151' are deactivated, and all three counters 45', 46' and 47' are reset to zero. The pipe cutting apparatus 75 will then automatically cut the pipe 25 into sections as the pipe is produced on the pipe forming apparatus 10.

The control panel 13 is provided with an on/off switch for the pipe cutting machine 75 and three speed adjustment knobs 135', 136', and 137'. The first speed adjustment knob 135' controls the production speed of the pipe as it is formed with the pipe forming machine 10. The second speed adjustment knob 136' controls the "slow down speed" at which the pipe is formed at the time the pipe surface flattening assembly 88 rollers 90, 92 move into their flattening contact position and subsequently flatten the pipe 25 surfaces. The third speed adjustment knob 137' controls the speed of the pipe when the outer knife 52 and inner knife 36 are cutting the pipe 25 (i.e. cutting speed).

The slow down speed is typically set at one-third the production speed and the cutting speed is typically set at one-half the production speed. The speed control knobs 135', 136', and 137' can be used to adjust the production speed, slow down speed, and cutting speed of the pipe during both manual and automatic modes of operation.

The cutting apparatus 75 operates in conjunction with the pipe producing machine 10 in an automatic mode in the following manner. The spiral pipe forming process is initiated with the pipe forming machine 10 in a known way. When the leading edge of the pipe 25 begins to leave the forming head 21, the pipe producing machine is temporarily halted, and the pipe cutting apparatus 75 is energized by turning the on/off switch on the control panel 13. The pneumatic cylinder assemblies 60, 82, 124, and 104 are initialized to be in their standby positions, so that the upper roller 90 and lower roller 92 are not in contact with the pipe 25, and that the outer knife 52 does not overlap the inner knife 36. The first counter 45', the second counter 46', and the third counter 47' are set to zero. Air is sent to the axial motion cylinder 125 to fully retract piston 130, so that upper roller 90, lower roller 92, and inner roller 48 are in the begin-roll position.

In a typical example of automatic operation, the first counter 45' may be set at 1250 pulses for pipe length, the second counter 46' may be set at 1050 pulses for the slow down point, and the third counter 47' may be set at 375 pulses for cut length. A cutting cycle begins by resetting all three counters 45', 46', and 47' to zero, and by cutting the part of the pipe 25 that extends past the inner and outer knives while in the begin-cut position. This part of the pipe will be referred to as the "lead section."

When the pulse count is at zero in all the three counters, the control box 44' send a first signal, via line 48', to the pneumatic cylinder assemblies 60 and 82. The respective pistons 62 and 81 are thereby pushed to their extended positions. The outer knife 52 and support roller 74 are moved to the cutting position where the cutting edges of the inner and outer knives puncture the pipe 25. The first signal also reverses the direction of air supplied to the axial motion cylinder 124, so that the piston 130 pushes the shaft connector 33, and all components connected to the guide shafts 32, axially with the pipe. The pipe forming machine 10 continues to produce the pipe 25 in a spiral manner at the cutting speed. The pipe 25 thus moves axially with, and rotates between, the overlapping inner knife 36 and the outer knife 52. The encoder 27' generates a train of pulses that correspond to the length of the next section of pipe being formed, which has its leading edge at the overlapping knives. This section of pipe will be referred to as the "new section". All three counters 45', 46', 47' count in unison as the new section of pipe is formed and the leading section of pipe is severed.

The guide shafts 32 allow the inner and outer knives to move in the axial direction of the pipe under the forces provided by the new section of pipe pushing on the overlapping knives and the extension of the axial motion piston 130. Thus, the inner knife 36, outer knife 52 and support roller 74 cooperate to cut around the complete circumference of the leading section of pipe as the pipe moves axially and rotates between the inner and outer knives. Thus, the third pulse count will be set at the number of pulses corresponding to the axial travel corresponding to slightly more than one pipe rotation. It is generally preferred to have a little overlap in the cut to assure that the leading pipe section is completely severed.

When the third pulse count is reached, the third counter 47' stops counting, but the first and second counters 45' and 46' continue to count as the new section of pipe continues to be produced. At this time, the control box 44' sends a second signal to the pneumatic cylinder assemblies 60, 82 and 124. This second signal indicates that the cutting process is completed, and thus operates the pneumatic cylinders 61, 83 and 125 to fully retract their respective pistons. The outer knife 52 and support roller 74 are thus moved to their standby positions. The air supplied to the cylinder 125 is also reversed, so that the piston 130 pulls the cutting assembly 75 back to its begin-cut position. When the third pulse count is reached, the new section of pipe stops being produced at the cutting speed, and begins to be formed at the production speed.

The new section of pipe will continue to be produced at the production speed, and the first and second counters 45', 46' will continue to count pulses, until the second pulse count is achieved. At that time, the slow-down point will be reached. The second counter 45' will stop counting, and the new section of pipe will be formed at the slow-down speed.

Simultaneous with reaching the slow down point, the control box 44' sends a third signal to the pneumatic assembly 104, making the piston 110 retract. This will pivot the upper roller 90 and lower roller 92 into flattening contact position with the pipe 25. This signal also reverses the direction of air supplied to the axial motion cylinder 125 so that the piston 130 pushes the shaft connector 33, and all components connected to the guide shaft 32, including the boom 28, and the rollers 48, 90, and 92, axially with the pipe 25. The guide shafts 32 allow the inner roller 48, upper roller 90, and lower roller 92 to move in the axial direction of the pipe during the flattening process in the same manner as the outer knife 52 and inner knife 36 did during the cutting process described above. Thus, the inner roller 48, upper roller 90, and lower roller 92 cooperate to flatten the raised surface irregularities on the pipe in a circumferential band between the rollers as the pipe moves axially and rotates between the rollers.

When the pipe 25 has rotated slightly over 180 degrees after coming into flattening contact with the rollers 90, 92, the leading end of the pipe will come into contact with the limit switch 136. Also, the length counter 45' will have reached its pulse count. At this time all three counters 45', 46', 47' reset to zero. Upon switch contact, the limit switch 136 sends an electrical signal to the control box 44', which in turn sends a signal to the pipe forming machine 10 to temporarily stop pipe production. Simultaneously with stopping pipe production, the control box 44' sends a signal to the pneumatic cylinder assemblies 124 and 104. This signal indicates that the flattening process is completed, and will operate pneumatic cylinder 108 to fully extend piston 110, thus pivoting the upper roller 90 and lower roller 92 to their standby position. The air supplied to cylinder 125 is also reversed, so that the piston 130 pulls the cutting apparatus 75, mounted to the guide shafts 32, back to its begin-cut position. As the cutting apparatus is returning to the begin-cut position, the pipe 25 remains stationary due to the temporary halt of pipe production mentioned above. This allows for accurate positioning of the inner knife 36 and outer knife 52 over the center of the flattened circumferential band on the pipe just prior to cutting.

When the cutting apparatus 75 reaches the begin-cut position, a proximity sensor 138 senses the return of roller bracket 80 and sends a signal to the control box 44' which in turn sends a signal to the pneumatic cylinder assemblies 60, 82. The respective pistons 62 and 81 extend and move the outer knife 52 and support roller 74 into the cutting position. Momentarily thereafter, the control box 44' sends a signal to the pipe forming apparatus to resume pipe production at the cutting speed. The overlapping inner knife 36 and outer knife 52 will then proceed to cut the moving pipe 25 as previously described. The pipe flattening and cutting process described above is repeated as additional sections of pipe are produced.

The control scheme just described for the pipe cutting apparatus 75 is generally preferred because the pulse counts for the pipe length, slow-down point and cut length can be set independently, and the cut length is automatically accounted for in the pipe length.

It should be understood that changes and modifications to the preferred embodiment described above will be apparent to those skilled in the art. It is intended that the foregoing description be regarded as illustrative rather than limiting, and that it is the following claims, including all equivalents thereof, which are intended to define the scope of the invention.

I claim:

1. An apparatus for flattening irregular circumferential surfaces in spirally formed pipe wherein the pipe moves in an axial direction and rotates while it is being formed, comprising:

inner surface flattening means to be positioned inside the pipe;

outer surface flattening means to be positioned outside the pipe;

first moving means for moving the outer surface flattening means into contact with the pipe at a position vertically aligned with the inner surface flattening means;

guide means for allowing the inner surface flattening means and outer surface flattening means to move in the axial direction of the pipe, so that the inner and outer surface flattening means will cooperate to flatten raised surface irregularities on the pipe as the pipe moves axially and rotates between the inner and outer surface flattening means.

2. The apparatus of claim 1 wherein the outer surface flattening means comprises:

an upper flattening roller attached to an upper lever arm and positioned above the pipe; and a lower flattening roller attached to a lower lever arm and positioned below the pipe, opposite the upper flattening roller.

3. The apparatus of claim 1 wherein the inner surface flattening means comprises a cylindrical roller rotatably mounted inside the pipe.

4. The apparatus of claim 1 wherein the inner surface flattening means and outer surface flattening means are adapted to be rotationally driven by contact with the rotating pipe.

5. The apparatus of claim 1 wherein the first moving means for moving the outer surface flattening means into contact with the pipe comprises a pneumatic cylinder assembly having adjustment means for adjusting the contact pressure of the outer surface flattening means against the pipe.

6. The apparatus of claim 1 further comprising means for controlling the first moving means to move the outer surface flattening means into contact with the pipe in response to a signal corresponding to a predetermined length of pipe, and to move the outer surface flattening means out of contact with the pipe after the irregularities in the cylindrical surfaces have been flattened by the inner and outer surface flattening means.

7. An apparatus for cutting spirally formed pipe having irregular, non-smooth cylindrical surfaces, wherein the pipe moves in an axial direction and rotates while it is being formed, comprising:

a boom with an end positioned inside the pipe;

an arbor fixedly secured to the end of the boom located inside the pipe;

an inner surface flattening means that is rotatably mounted to the arbor inside the pipe;

outer, rotatable, surface flattening means to be positioned outside the pipe;

inner knife means that is rotatably mounted to the arbor inside the pipe;

outer rotatable knife means to be positioned outside the pipe;

support roller means to be positioned outside the pipe and opposite the outer knife means;

first moving means for moving the outer surface flattening means into contact with the pipe at a positioned vertically aligned with the inner surface flattening means;

second moving means for moving the outer knife means to a position where it overlaps the inner knife means;

third moving means for moving the support roller means to a position where it will contact the pipe; and guide means for allowing the boom, arbor, inner surface flattening means, outer surface flattening means, inner knife means, and outer knife means, and the support roller means to move in the axial direction of the pipe, so that the inner and outer surface flattening means will cooperate to flatten irregularities on the cylindrical surfaces of the pipe and the inner and outer knife means will cooperate to cut the pipe as the pipe moves axially and rotates between the inner and outer surface flattening means and the inner and outer knife means.

8. The apparatus of claim 7 wherein the outer surface flattening means comprises:

an upper flattening roller attached to an upper lever arm and positioned above the pipe; and a lower flattening roller attached to a lower lever arm and positioned below the pipe, opposite the upper flattening roller.

9. The apparatus of claim 7 wherein the inner surface flattening means comprises a cylindrical roller rotatably mounted concentrically about the arbor.

10. The apparatus of claim 7 wherein the inner surface flattening means, outer surface flattening means, inner knife means, outer knife means, and the support roller means are adapted to be rotationally driven by contact with the rotating pipe.

11. The apparatus of claim 7 wherein the first moving means for moving the outer surface flattening means into contact with the pipe comprises a pneumatic cylinder assembly having adjustment means for adjusting the contact pressure of the outer surface flattening means against the pipe.

12. The apparatus of claim 7 further comprising means for controlling the first moving means to move the outer surface flattening means into contact with the pipe in response to a signal corresponding to a predetermined length of pipe, and to move the outer surface flattening means out of contact with the pipe after the irregularities in the cylindrical surfaces have been flattened by the inner and outer surface flattening means.

13. The apparatus of claim 7 further comprising means for controlling the second moving means to move the outer knife means to the cutting position in response to a signal corresponding to a predetermined length of pipe, and to move the outer knife means out of the cutting position after the pipe has been completely cut.

14. The apparatus of claim 7, further comprising means for controlling the third moving means to move the support roller means into contact with the pipe in response to a signal corresponding to a predetermined length of pipe, and to move the support roller means out of contact with the pipe after the pipe has been completely cut.

* * * * *

UNITED STATES PATENT AND TRADEMARK OFFICE

CERTIFICATE OF CORRECTION

PATENT NO. : 5,020,351

DATED : June 4, 1991

INVENTOR(S) : Wilhelmus P. H. Castricum

It is certified that error appears in the above-identified patent and that said Letters Patent is hereby corrected as shown below:

ON THE TITLE PAGE

In the Abstract, line 13, please delete "wire" and substitute therefor --knife--.

Column 4, line 25, please delete "is" and substitute therefor --in--.

Column 9, line 26, please delete "150," and substitute therefor --150',--.

Signed and Sealed this

Twenty-second Day of March, 1994

*Attest:*

Bruce Lehman

BRUCE LEHMAN

*Attesting Officer*

*Commissioner of Patents and Trademarks*